United States Patent [19]

Ellstrom

[11] Patent Number: 4,598,520

[45] Date of Patent: Jul. 8, 1986

[54] WINDOW PANEL

[76] Inventor: Sven H. Ellstrom, c/o Ellstrom Manufacturing, Inc., 1540 NW. Ballard Way, Seattle, Wash. 98107

[21] Appl. No.: 679,270

[22] Filed: Dec. 7, 1984

[51] Int. Cl.[4] ..... E06B 3/70

[52] U.S. Cl. ..... 52/456; 52/314; 52/788

[58] Field of Search ..... 52/456, 314, 311, 788, 52/790, 455; 428/38, 34; 49/50, 57

[56] References Cited

U.S. PATENT DOCUMENTS

| | | | |
|---|---|---|---|
| 998,620 | 7/1911 | Leonard . | |
| 2,408,281 | 9/1946 | Wilkin | 49/57 X |
| 3,308,593 | 3/1967 | Smith . | |
| 3,918,202 | 11/1975 | Smith | 52/456 X |
| 4,368,226 | 1/1983 | Mucaria | 52/790 X |
| 4,438,165 | 3/1984 | Butler . | |

*Primary Examiner*—Carl D. Friedman

*Attorney, Agent, or Firm*—Christensen, O'Connor, Johnson & Kindness

[57] ABSTRACT

An insulated window panel is provided with pseudo sash bar lattices that are affixed, preferably by dual-sided adhesive foam tape, in coincidental alignment to the outwardly facing transparent surfaces of the panel. Dual-and triple-glazed window panels constructed in accordance with the present invention have the appearance of being constructed of a plurality of small panes or panels that are surrounded and held in planar array by sash bars. The resemblance to French-style windows is achieved by means of a remarkable trompe l'oeil effect that results when pseudo sash bar lattices are affixed in coincidental alignment on opposite sides of the panel. Also disclosed is a novel triple-glazed insulated panel wherein the insulating peripheral seal is protected by providing a central pane with slightly reduced height and width dimensions relative to those of the two outwardly facing panes.

31 Claims, 7 Drawing Figures

12
10
38
26
30
32
34
18
20
14
22
16
13

WINDOW PANEL

FIELD OF THE INVENTION

This invention relates to insulated window panels and, more particularly, to single, dual- and triple-glazed windows that simulate the appearance of French-style windows.

DESCRIPTION OF THE PRIOR ART

Windows in which a single glass windowpane defines the transparent opening within the window frame or casement are referred to herein as "plain windows". Such plain windows are admirably suited for most purposes. However, certain architectural plans call for windows in which a plurality of glass panes are disposed in planar array within the window frame or casement. For example, a French-style window has a plurality of glass panes arranged in a rectangular pattern within a hinged casement. Other patterns, including diamond-shaped patterns formed by arranging a plurality of rhomboidal panes in planar array, are also popular. The light frame members that hold the panes in planar array are referred to herein as "sash bars." Windows that have a plurality of panes held in planar array by sash bars, whether arranged in rectangular, diamond, or other patterns, are referred to herein as "French-style windows."

French-style windows are advantageously incorporated into certain traditional architectural settings, and this style of window is popular in homes and other dwellings. French-style windows have two disadvantages however. First, they are considerably more expensive to manufacture than plain windows, and, second, they are more difficult to clean. To solve the second disadvantage, plain windows have been provided with a device that simulates a lattice of sash bars, the device overlies one side of the windowpane and removably fastens to the window frame or casement. Thus, the device may be removed and the windowpane surface cleaned in one continuous cleaning operation. Such devices have not met with widespread commercial acceptance however, especially among builders of expensive homes, because a plain window that is overlaid by such a device is unconvincing: it does not look like a genuine French-style window.

Dual-glazed, insulated window panels have also been manufactured, and these may be generally characterized as including first and second glass panes in spaced parallel array with a peripheral spacer frame bonded therebetween to enclose an insulating pocket of air between the panes. Conventional triple-glazed insulated window panels include three glass panes of identical dimensions: a third pane is centrally positioned in spaced parallel array between first and second outwardly facing panes, with peripheral spacer frames bonded therebetween to form two insulating air pockets within the panel. Triple-glazed and quadruple-glazed insulated window panels in which the centrally positioned pane or panes are polymeric sheets, e.g., of UV-protected polyester film, have also been manufactured.

U.S. Pat. No. 3,308,593 discloses a dual-glazed insulated window panel that is provided with a decorative grillwork in the air pocket between the glass panes. The decorative grillwork is connected to the peripheral spacer frame. Because the decorative grillwork is sandwiched between the glass panes, each outwardly facing surface of the panel may be cleaned in one continuous cleaning operation without disturbing or contacting the decorative grillwork. However, the volume of the insulating air pocket is reduced, and the grillwork may facilitate the transfer of heat across the air pocket. Moreover, the resulting window panel does not look like a genuine French-style window because, e.g., a reflective glass surface is disposed between the viewer and the grillwork.

U.S. Pat. No. 4,438,165 discloses simulated stained and leaded glass windows using lead strips which are coated with adhesive and applied to one side of a clear glass pane to define closed areas of a selected pattern. Painted or pigmented polyester film is coated with adhesive and applied to the opposite side of the pane in coincidental alignment with the aforesaid defined closed areas. Lead strips may then be applied to the second side of the pane coinciding with the original lead strips.

SUMMARY OF THE INVENTION

An insulated window panel is provided with pseudo sash bar lattices that are affixed, preferably by dual-sided adhesive foam tape, in coincidental alignment to the outwardly facing transparent surfaces of the panel. Dual-and triple-glazed window panels constructed in accordance with the present invention have the appearance of being constructed of a plurality of small panes or panels that are surrounded and held in planar array by sash bars. The resemblance to such French-style windows is achieved by means of a remarkable trompe l'oeil effect that results when pseudo sash bar lattices are affixed in coincidental alignment on opposite sides of the panel. Also disclosed is a novel triple-glazed insulated panel wherein the peripheral seal is protected by providing a central pane with slightly reduced height and width dimensions relative to those of the two outwardly facing panes.

DESCRIPTION OF THE PREFERRED EMBODIMENTS

Pursuant to the teachings of the present invention insulated plain windows, which include first and second transparent panes disposed in spaced parallel array, can be made to resemble French-style windows. A remarkable trompe l'oeil effect is created by affixing pseudo sash bars in coincidental alignment on opposite sides of the panel. The effect of the trompe l'oeil optical illusion is reinforced if the flat, inwardly facing base of each pseudo sash bar is painted or pigmented to contrast with the color or tone of the outwardly facing surfaces of the pseudo sash bars. In a preferred embodiment a black dual-sided adhesive foam tape is used to affix the base of each pseudo sash bar to the insulated window panel.

Figure 1:
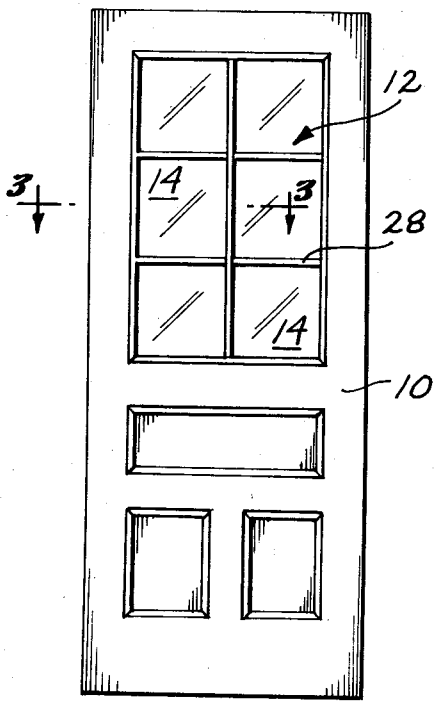
FIG. 1 is a normal view of a door that contains an insulated window panel of the present invention.

Referring now to FIG. 1 a door 10 is provided with an insulated window construction 12 of the present invention. The window construction 12 resembles a French-style window, that is, a window constructed of six individual glass panes or panels that are surrounded and retained within a solid rectangular sash bar lattice of traditional construction.

Figure 3:
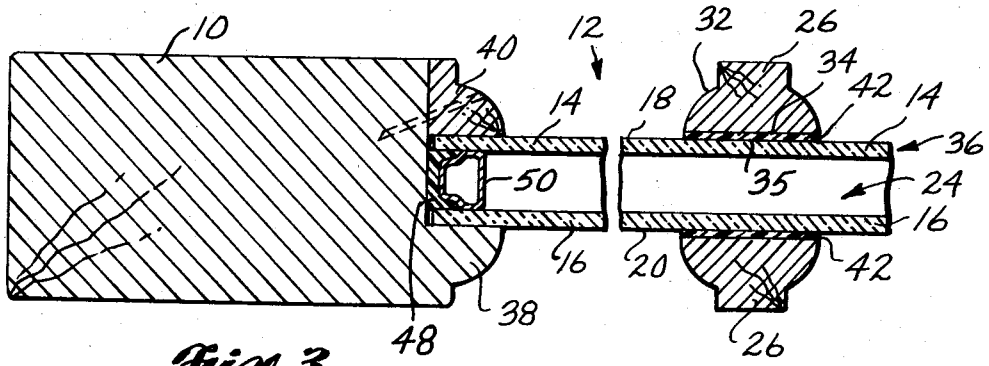
FIG. 3 is an enlarged cross section through a dual-glazed window panel along the sight lines indicated in FIG. 1.
Figure 2:
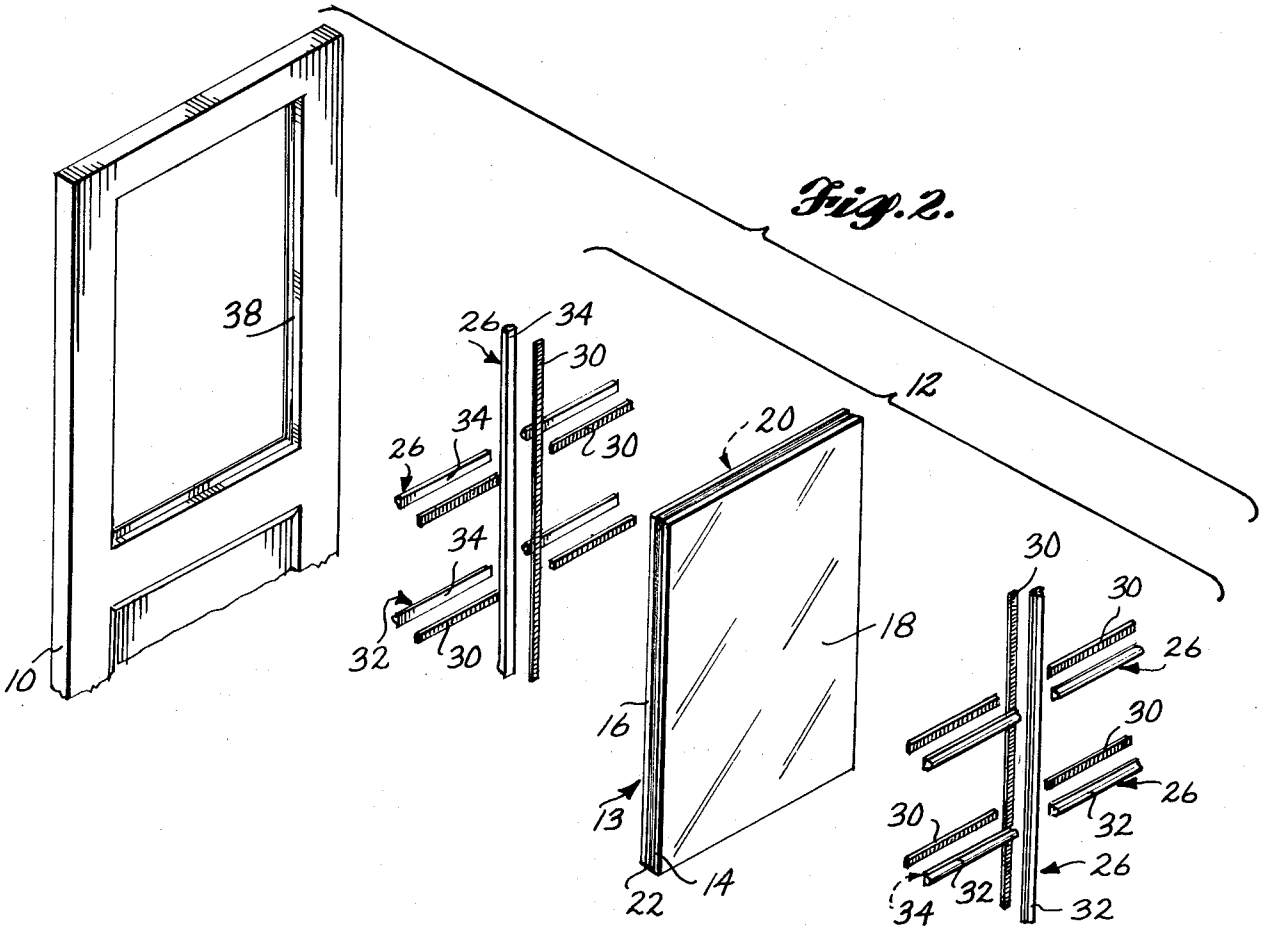
FIG. 2 is an exploded oblique view showing the components of the window panel of FIG. 1.

Referring now to FIG. 2 the components of a window construction 12 of the present invention are shown in exploded array. An insulated window panel 13 includes first and second spaced, transparent panes 14, 16 having corresponding first and second outwardly facing surfaces 18, 20 on opposite sides of the panel 13. A peripheral spacer construction 22 bonds to the inwardly facing surfaces of the first and second panes 14, 16. The panes 14, 16 and spacer frame 22 thereby enclose an insulating pocket of air 24, as shown in FIG. 3. Pursuant to the teachings of the present invention a plurality of pseudo sash bars 26 are affixed to the first and second outwardly facing glass surfaces 18, 20 to form coincidentally aligned pseudo sash bar lattices 28, one of which can be seen in FIG. 1. In the embodiment shown in FIG. 2, pigmentary members 30 are sandwiched between the pseudo sash bars 26 and the outwardly facing glass surfaces 18, 20.

The pseudo sash bars 26 can be made of wood or plastic, of solid or hollow construction, and can be shaped or formed so that their outwardly facing surfaces 32 resemble those of the traditional sash bars that are disposed between the individual panes in French-style windows. For example, the pseudo sash bars 32 can be made so that their outwardly facing surfaces 32 have an ogee-type cross section, with outwardly facing reversed curved sides that meet at the apex of the ogee. However, unlike the sash bars used in traditional French-style windows, a pseudo sash bar 26 of the present invention has a flat base 34 that can be abutted against and affixed to a transparent surface 18, 20 of a windowpane 14, 16.

The dimensions of the pseudo sash bars 26 can be varied for architectural or aesthetic effect. Pseudo sash bars 26 constructed of one-inch stock, that is, with a width of three-quarter inches, resemble the dimensions of the sash bars used in many traditional French-style windows.

It is aesthetically desirable to position the pseudo sash bars 26 to form a pseudo sash bar lattice 28. The pseudo sash bars 26 can be integrated into a pseudo sash bar lattice 28 before the lattice 28 is affixed to the windowpane surface 18, 20. Alternatively, the lattices 28 can be formed as the individual pseudo sash bars 26 are sequentially affixed to the windowpane surfaces 18, 20.

In this embodiment the pseudo sash bars 26 are arrayed in rectangular lattices 28, one on each side of the insulated window panel 13, and so the completed window construction 12, as shown in FIG. 1, will resemble a six-paned French-style window. In other embodiments the pseudo sash bars 26 can be arranged in diagonal array to form diamond-shaped lattices 28 on the panel 13. Alternatively, a window with a lower lifting sash can be simulated by disposing the pseudo sash bar lattices 28 across only the upper half of the window panel 13. Other patterns and designs can be readily devised and affixed to meet the aesthetic desires of the ultimate consumer. Moreover, because pseudo sash bar stock can be readily affixed to standard insulated window panels in any number of patterns and designs, inventory and warehouse costs can be economized by the practice of the present invention.

To create the optical illusion that the coincidentally aligned pseudo sash bar lattices 28 on opposite sides of the panel 13 are connected to each other, that is, that the window construction 12 is made up of a plurality of smaller panes or insulated panels held together in planar array by a solid sash bar framework, it is important, in fact critical, that the pseudo sash bar lattices 28 be affixed in coincidental alignment on opposite sides of the panel 36. By "coincidental alignment" is meant that the pseudo sash bars 26 are registered on the first and second outwardly facing glass surfaces 18, 20 so that one lattice 28 covers and conceals the other 28 when viewed from a vantage point perpendicular to the plane of projection from one transparent pane 14 of the panel 13, as in FIG. 1.

The base 34 of each pseudo sash bar lattice 28 must also be snugly compressed against an outwardly facing glass surfaces 18, 20. The aforesaid optical illusion can best be achieved by affixing the base 34 of each pseudo sash bar lattice 28 to the window panel 36. A cement such as a two-part epoxy resin can be used to affix the pseudo sash bars 26 to the glass surfaces 18, 20. Alternatively, as shown in FIG. 2, pigmentary members 30 composed of, e.g., dual-sided adhesive tape can be interposed between the pseudo sash bars 26 and the window panel 13. If a dual-sided adhesive foam tape 30 is employed, a preformed pseudo sash bar lattice 28 can be readily and snugly compressed against a windowpane surface 18, 20, as the foam will accommodate any minor irregularity in the pitch of the lattice 28, and the adhesive material on both sides of the foam tape will form quick and clean adhesive bonds. The width of such a pigmentary member 30 should conform to or be slightly less than the width of the pseudo sash bar base 34 which the pigmentary member 30 underlies. In an alternative embodiment two parallel strips of pigmentary members 30 such as either of the aforementioned tapes can be employed, with the combined widths of the pigmentary strips 30 being less than the width of the overlying pseudo sash bar base 34.

In order for the window constructions 12 of the present invention to resemble the traditionally constructed multi-paned windows of the prior art, it is preferable to select a dual-sided adhesive foam tape or other pigmentary member 30 that has a color or tone that contrasts with the color or tone of the outwardly facing surfaces 32 of the pseudo sash bars 26. The aforesaid desirable optical illusion is best achieved if the dual-sided adhesive foam tape 30 is pigmented black, that is, windows 12 of the present invention so constructed will most closely resemble traditional French-style windows. It is preferable to employ a black pigmentary member 30 in conjunction with pseudo sash bar lattices 28 whose outwardly facing surfaces 32 are pigmented white or have a natural wood finish. The desirable optical illusion can likewise be achieved by interposing a black pigmentary member 30 other than a dual-sided adhesive foam tape between the pseudo sash bar bases 34 and the glass surfaces 18, 20. It should be emphasized that the desirable optical illusion can also be achieved by directly affixing the pseudo sash bars 26 to the glass surface 14, 16 using a cement or other adhesive material admixed with a black pigment. The desirable optical illusion can also be achieved by forming or painting the pseudo sash bars 26 so that their base portions 34 are pigmented black, and then affixing the base portions 34 to the glass surface 18, 20 with transparent cement. It may also be desirable for certain aesthetic purposes to pigment the pigmentary member 30, adhesive material, or pseudo sash bar base 34 with a color or tone that matches that of the outwardly facing surfaces 32 of the pseudo sash bars 26. It should also be understood that for the purposes of practicing the present invention only the pigment that abuts the glass surface 18, 20 can be seen through the opposite side of the panel 13, and so, e.g., only the inwardly facing surface 35 of the dual-sided adhesive foam tape 30 need be of the specified or desired color or tone.

Referring now to FIG. 3, a dual-glazed insulated window construction 12 of the present invention can be mounted into the window frame or casement 38 of a door 10 or wall using conventional moldings 40. The first and second spaced, transparent panes 14, 16 have corresponding first and second outwardly facing surfaces 18, 20 on opposite sides of the dual-glazed insulated panel 36. The pseudo sash bars 26 that make up the pseudo sash bar lattices 28 are affixed to the first and second outwardly facing glass surfaces 18, 20. The pseudo sash bars 26 are registered in coincidental alignment on opposite sides of the insulated panel 36. The pseudo sash bars 26 can be affixed, as described above, to the glass surfaces 18, 20 using an adhesive material or pigmentary layer that is generally referenced in this view by the numeral 42.

Figure 4:
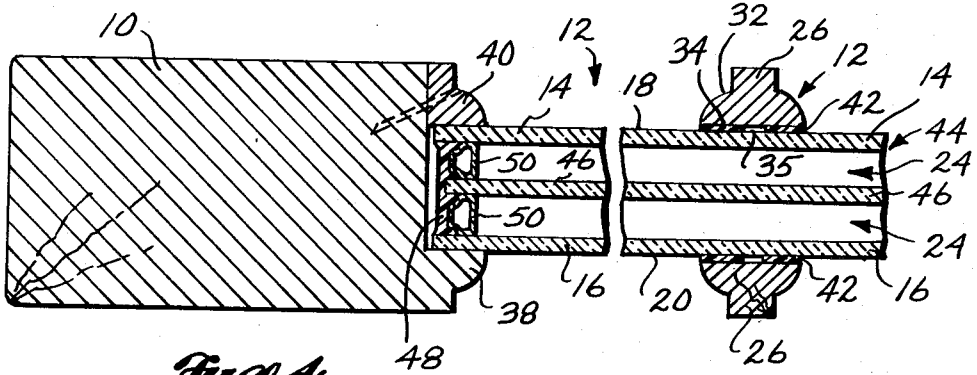
FIG. 4 is an enlarged cross section similar to FIG. 3 but through a triple-glazed insulated window panel of the present invention.

Referring now to FIG. 4 a triple-glazed insulated window panel 44 can also be fitted with pseudo sash bars 26 in accordance with the present invention. Here a third glass or plastic pane 46 is centrally positioned in spaced parallel array between first and second outwardly facing panes 14, 16. The pseudo sash bars 26 that make up the pseudo sash bar lattices 28 are affixed by an adhesive material 42 in coincidental alignment to the outwardly facing surfaces 18, 20 of the first and second panes 14, 16.

Because the pseudo sash bars 26 contact only the outwardly facing surfaces 18, 20 of the first and second panes 14, 16, a plurality of central panes, of either glass or polymeric construction, can be incorporated into the insulated window panel 13 without departing from the teachings of the present invention.

While the present invention can be practiced with conventional dual-glazed, triple-glazed, and other insulated window panels, the pseudo sash bars 26 of the present invention can also be affixed to the outwardly facing glass surfaces 18, 20 of a novel triple-glazed insulated window panel 44 of the present invention. As shown in FIG. 4 this novel triple-glazed window panel 44 is constructed with a central pane 46 that has slightly reduced dimensions, height and width, relative to those of the two outwardly facing panes 14, 16. For example, the width of the central pane 46 can be about one-half to three-quarter inches less than the width of each of the two outwardly facing panes 14, 16. The height of the central pane 46 can also be reduced by an identical or proportional increment. Window panels 44 so constructed provide two-point rather than three-point peripheral contact and so are less liable to break during handling and installation. Moreover, because the recessed central pane 46 is inaccessible to peripheral contacts that might jar and break the adhesive bond 48 between the central pane 46 and the peripheral spacer frames 50, a more durable seal is provided by constructing triple-glazed insulated window panels 44 in accordance with these teachings. Improved quadruple-glazed insulated panels can likewise be constructed by recessing the two central panes.

The pseudo sash bars 26 of the present invention can also be affixed in coincidental alignment on both sides of a single windowpane, in which case a plain window can be made to convincingly resemble a French-style window.

Figure 6:
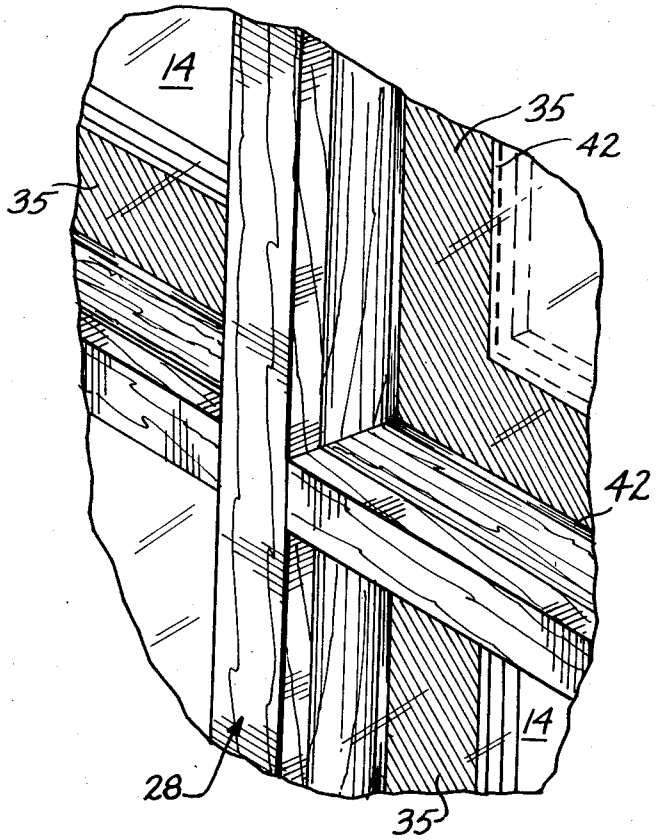
FIG. 6 is a view similar to FIG. 5 showing the remarkable trompe l'oeil effect whereby the panel appears to be constructed of a plurality of smaller panes or panels that are surrounded and retained in planar array by traditional sash bars.
Figure 5:
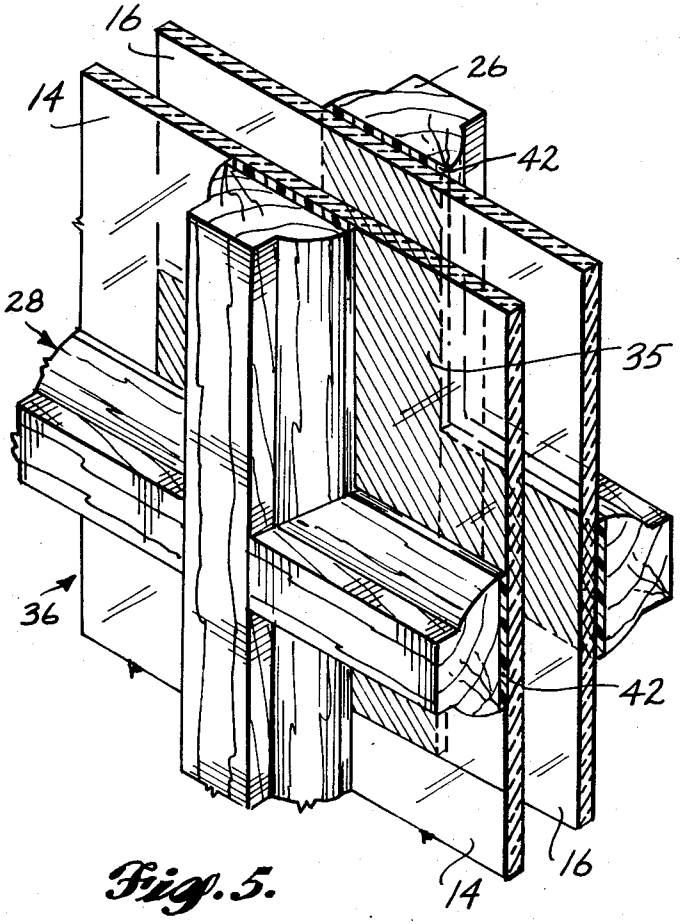
FIG. 5 is an oblique view through a portion of the insulated window panel of FIGS. 1 and 3.

Referring now to FIGS. 5 and 6 the remarkable optical illusion that results when plain windows are constructed in accordance with the present invention is illustrated. In this embodiment a dual-glazed panel 36 is fitted with black dual-sided adhesive foam tape 42 interposed between each of two rectangular pseudo sash bar lattices 28 on opposite sides of the panel 36. In this view the coincidentally aligned pseudo sash bar lattices 28 are viewed at an oblique angle, and so the viewer sees the pigmentary inwardly facing tape surface 37 that is affixed to the opposite side of the panel 36. The contrasting tone, relative to that of the outwardly facing surfaces 32 of the pseudo sash bar lattice 28, of the inwardly facing tape surface 37 fools the eye and brain into perceiving the dark strips 37 as outlining the sash bars or sidewalls of a plurality of small, individual dual-glazed panels.

Figure 7:
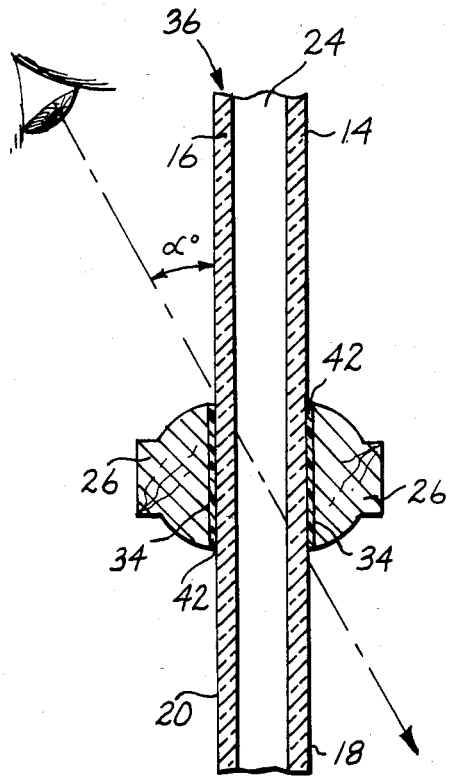
FIG. 7 is a cross section similar to FIG. 3 but showing the oblique viewing angle that will achieve the desirable optical illusion.

Referring now to FIG. 7 it should be understood that if the angle of view $\alpha°$, is made sufficiently small with respect to the plane of the panel 36 the viewer will see "daylight" between the registered pseudo sash bars 26. However, if the pseudo sash bar lattices 28 are constructed such that the width of the narrowest pseudo sash bar base 34 in each lattice 28 is approximately equal to or preferably is greater than the distance between the first and second outwardly facing glass surfaces 18, 20, most viewing angles, $\alpha°$, will produce the desirable optical illusion. For example, if the pseudo sash bars 26 are three-quarter inches wide and the window panel 36 is one-half inches wide, any viewing angle , $\alpha°$, in excess of approximately 32° will produce the desirable optical illusion.

While the present invention has been described in conjunction with preferred embodiments, one of ordinary skill after reading the foregoing specification will be able to effect various changes, substitutions of equivalents, and other alterations to the articles of manufacture set forth herein. It is therefore intended that the protection granted by letters patent hereon be limited only by the definition contained in the appended claims and equivalents thereof.

The embodiments of the invention in which an exclusive property or privilege is claimed are defined as follows:

1. In an insulated widow panel that includes first and second spaced, transparent panes having corresponding first and second outwardly facing surfaces on opposite sides of said panel, the improvement in combination therewith comprising a first pseudo sash bar affixed by adhesive means to said first surface and a second pseudo sash bar affixed by adhesive means to said second surface in coincidental alignment with said first pseudo sash bar on the opposite side of said panel, the width of said pseudo sash bars relative to the distance between said first and second outwardly facing surfaces being such that said panel provides the appearance of conventional windows separated by conventional sash bars from most viewing angles and from both sides of said window panel.

2. The improved window panel of claim 1, wherein a plurality of said pseudo sash bars are affixed to said surfaces to form pseudo sash bar lattices on opposite sides of said panel.

3. The improved window panel of claim 2, wherein said pseudo sash bars are affixed in rectangular pseudo sash bar array on opposite sides of said panel.

4. The improved window panel of claim 2, wherein said pseudo sash bars are affixed in diamond-shaped pseudo sash bar array on opposite sides of said panel.

5. The improved window panel of claim 2, wherein the inwardly facing base of each pseudo sash bar lattice is flat.

6. The improved window panel of claim 5, wherein the width of the bases of said pseudo sash bars in each lattice is approximately equal to the distance between said first and second outwardly facing surfaces.

7. The improved window panel of claim 5, wherein the width of the bases of said pseudo sash bars is greater than the distance between said first and second outwardly facing surfaces.

8. The improved window panel of claim 5, wherein said pseudo sash bar bases are the same color or tone as the outwardly facing surfaces of said pseudo sash bar lattices.

9. The improved window panel of claim 5, wherein said pseudo sash bar bases are a color or tone that contrasts with the color or tone of the outwardly facing surfaces of said pseudo sash bar lattices.

10. The improved window panel of claim 5, wherein said pseudo sash bar bases are pigmented black.

11. The improved window panel of claim 2, wherein a pigmentary member that generally conforms to the configuration of the inwardly facing base of each pseudo sash bar lattice is interposed between at least one of said pseudo sash bar lattices and said transparent surfaces.

12. The improved window panel of claim 11, wherein said pigmentary member is a dual-sided adhesive tape.

13. The improved window panel of claim 11, wherein said pigmentary member is a dual-sided adhesive foam tape.

14. The improved window panel of claim 11, wherein the width of said pigmentary member is slightly less than the width of each pseudo sash bar base in said pseudo sash bar lattice.

15. The improved window panel of claim 11, wherein the pigmentary member comprises two parallel strips, the combined widths of said strips being less than the width of the overlying pseudo sash bar base.

16. The improved window panel of claim 11, wherein said pigmentary member is the same color as the outwardly facing surfaces of said pseudo sash bar lattice.

17. The improved window panel of claim 11, wherein said pigmentary member is a color or tone that contrasts with the color or tone of the outwardly facing surfaces of said pseudo sash bar lattice.

18. The improved window panel of claim 11, wherein said pigmentary member is pigmented black.

19. The improved window panel of claim 18, wherein the outwardly facing surfaces of said pseudo sash bar lattice are pigmented white.

20. The improved window panel of claim 18, wherein the outwardly facing surfaces of said pseudo sash bar lattice have a natural wood finish.

21. The improved window panel of claim 11, wherein said pigmentary member is pigmented black on its inwardly facing side that affixes to the panel.

22. The improved window panel of claim 2, wherein said panel is a dual-glazed insulated window panel.

23. The improved window panel of claim 2, wherein said panel is a triple-glazed insulated window panel.

24. The improved window panel of claim 23, wherein the central pane of said triple-glazed insulated window panel has reduced dimensions relative to those of said first and second outwardly facing panes.

25. The improved window panel of claim 2, wherein said panel is a quadruple-glazed insulated window panel.

26. The improved window panel of claim 25, wherein the two central panes of said quadruple-glazed insulated window panel have reduced dimensions relative to those of said first and second outwardly facing panes.

27. The improved window panel of claim 1, wherein said pseudo sash bar lattices are affixed to said surfaces by cement.

28. The improved window panel of claim 27, wherein the cement is transparent.

29. The improved window panel of claim 27, wherein the cement is the same color or tone as the outwardly facing surfaces of said pseudo sash bar lattices.

30. The improved window panel of claim 27, wherein the cement is a color or tone that contrasts with the color or tone of the outwardly facing surfaces of said pseudo sash bar lattices.

31. The improved window panel of claim 27, wherein the cement is pigmented black.

* * * * *